US008138432B2

(12) United States Patent
Larsen et al.

(10) Patent No.: US 8,138,432 B2
(45) Date of Patent: Mar. 20, 2012

(54) ELECTRICAL SWITCH ASSEMBLY

(75) Inventors: Christopher Larsen, Mississauga (CA); Albert Beyginian, Aurora (CA); Theodor Nuica, London (CA)

(73) Assignee: Omron Dualtec Automotive Electronics Inc., Oakville (CA)

( * ) Notice: Subject to any disclaimer, the term of this patent is extended or adjusted under 35 U.S.C. 154(b) by 286 days.

(21) Appl. No.: 12/401,230

(22) Filed: Mar. 10, 2009

(65) Prior Publication Data

US 2009/0229961 A1 Sep. 17, 2009

Related U.S. Application Data

(60) Provisional application No. 61/036,358, filed on Mar. 13, 2008.

(51) Int. Cl.
*H01H 9/00* (2006.01)
*H01H 9/18* (2006.01)

(52) U.S. Cl. ..... 200/5 R; 200/1 B; 200/517

(58) Field of Classification Search ..... 200/5 R, 200/5 A, 517, 339, 341, 344, 345
See application file for complete search history.

(56) References Cited

U.S. PATENT DOCUMENTS 3,603,756 A 9/1971 Carpentier et al.
4,638,131 A 1/1987 Kidd et al.
5,247,143 A * 9/1993 Suwa ..... 200/517
5,426,275 A 6/1995 Maeda et al.
5,426,675 A 6/1995 Kumar et al.
5,559,311 A 9/1996 Gorbatoff
5,693,920 A 12/1997 Maeda
5,719,361 A 2/1998 Lee
5,743,384 A 4/1998 Clark
5,834,716 A 11/1998 Lee
5,920,042 A * 7/1999 Gotoh ..... 200/5 R
5,950,810 A * 9/1999 Pan et al. ..... 200/344
(Continued)

FOREIGN PATENT DOCUMENTS

CA 2176845 C 11/1996

OTHER PUBLICATIONS

Hijazi, Mazen; International Search Report from corresponding PCT Application No. PCT/CA2009/000280: completed Jul. 15, 2009, received by applicant Jul. 20, 2009.

*Primary Examiner* — Michael Friedhofer
(74) *Attorney, Agent, or Firm* — Brett J. Slaney; John R. S. Orange; Blake, Cassels & Graydon LLP

(57) ABSTRACT

A switch assembly operating an electrical circuit using an elastomeric pad is provided. The elastomeric pad comprises one or more collapsible domes that are positioned such that a plunger element supported by the switch assembly collapses the domes when an actuation button is tilted. The plunger element may have a limiting mechanism to limit downward movement of the plunger element such that the collapsible domes are not overloaded. The body and plunger may also be formed with complementary profiled portions that restrict any one or more of fore/aft, side-to-side and up/down movements of the plunger with respect to the body to prevent abnormal loading on the collapsible domes to increase the lifecycle of the elastomeric portion. The elastomeric portion may also be adapted to provide both single and dual double detent feedback by using passive collapsible domes that provide tactile feedback without operating on the electrical circuit.

24 Claims, 16 Drawing Sheets

U.S. PATENT DOCUMENTS 5,990,435 A * 11/1999 Chao ..... 200/517
6,137,071 A * 10/2000 Yeh et al. ..... 200/344
6,653,586 B2 * 11/2003 Hsiung et al. ..... 200/517
6,737,592 B1 5/2004 Hoang et al.
6,750,406 B2 * 6/2004 Komatsu et al. ..... 200/1 B
6,914,202 B2 7/2005 Sugimoto et al.
6,933,925 B1 8/2005 Gibbons et al.
6,974,919 B2 * 12/2005 Mori et al. ..... 200/5 R
7,268,305 B2 * 9/2007 Schmidt et al. ..... 200/5 R
2008/0017491 A1 1/2008 Azizi et al.

* cited by examiner

ELECTRICAL SWITCH ASSEMBLY

This application claims priority from U.S. Application No. 61/036,358 filed on Mar. 13, 2008, the contents of which are incorporated herein by reference.

FIELD OF THE INVENTION

The invention relates to electrical switches and more particularly to electrical switches utilizing an elastomeric portion for actuating the switch

BACKGROUND

In automotive applications, electrical switches are often used for controlling electro-mechanical systems such as power windows, sunroofs, door locks, power mirrors, etc. These switches may often be integrated into a console or door frame along with other components and accessories. Due to the repeated use of many of the electrical switches, durability and reliability are paramount. Moreover, a malfunctioning switch can prevent the use of an important feature such as the ability to open or close a door window.

In addition to reliability, cost is an important issue in incorporating electrical features in an automobile. The cost of producing an electrical switch for the above applications can be affected by the materials used, the number of parts used and the assembly process to name a few. Accordingly, the often competing objectives of providing a low-cost component that is durable and reliable needs to be balanced.

Various prior art window switches teach specific arrangements for implementing switches in an automobile. In particular, such prior art switches teach multi-functional switches using a single toggle or "actuator knob". A single window switch may be used to provide dual-stage operation in both forward and rearward directions. The common application for such switches is to provide manual and automatic window operation for opening and closing same, wherein the application of a first force operates the window switch in a manual mode, and the application of a second force, being greater than the first force, operates the window switch in an automatic mode. Typically by applying the second force, the window continues to open without further tilting of the actuator knob. Generally, these window switches offer tactile feedback to the user enabling the user to discern between the manual mode and the automatic mode.

Examples of the above type of prior art switches are shown in U.S. Pat. No. 6,737,592 to Hoang et al., published on May 18, 2004; U.S. Pat. No. 6,914,202 to Sugimoto et al., published on Jul. 5, 2005; and U.S. Pat. No. 5,719,361 to Lee, published on Feb. 17, 1998.

In some switches, such as that shown in Lee, collapsible elastomeric domes are operated on by a actuator knob to bridge contacts on an underlying circuit board to in turn operate the switch. The elastomeric domes will often have a limited lifespan, which can vary according to the material used, the experience of any abnormal or irregular forces acting on the domes and the frequency of use. Abnormal and irregular forces can be affected by the actuating mechanism used and the force applied by the user and can cause the dome and thus the switch to fail prematurely.

There exists a need for an electrical switch that can address at least one of the above-described problems and provide a solution that balances cost and reliability.

SUMMARY

In one aspect, there is provided a switch assembly comprising a body; an actuation button pivotally supported by the body; an electrical circuit portion underlying the actuation button; an elastomeric portion overlying the electrical circuit portion, the elastomeric portion having at least one collapsible dome formed therein for providing a connection on the electrical circuit portion when the dome is in a collapsed position; a plunger element supported by the body between the actuation button and the elastomeric portion, the plunger element comprising a first upwardly directed portion bearing against the actuation button such that movement of the actuation button causes the plunger element to move towards the elastomeric portion, and a second downwardly directed portion aligned with the collapsible dome such that the movement of the actuation button beyond a predetermined threshold causes the plunger element to collapse the elastomeric dome; and a limiting mechanism between said plunger element and said elastomeric portion to restrict the movement beyond a lower limit to protect overloading of the collapsible dome.

In another aspect, there is provided a switch assembly comprising a body; an actuation button pivotally supported by the body; an electrical circuit portion underlying the actuation button; an elastomeric portion overlying the electrical circuit portion, the elastomeric portion having at least one collapsible dome formed therein for providing a connection on the electrical circuit portion when the dome is in a collapsed position; and a plunger element supported by the body between the actuation button and the elastomeric portion, the plunger element comprising a first upwardly directed portion bearing against the actuation button such that movement of the actuation button causes the plunger element to move towards the elastomeric portion, and a second downwardly directed portion aligned with the collapsible dome such that the movement of the actuation button beyond a predetermined threshold causes the plunger element to collapse the elastomeric dome, and at least one profiled portion for interacting with a complementary profiled portion on the body to restrict movement of the plunger element in the plane defined by the electrical circuit portion.

In yet another aspect, there is provided a switch assembly comprising a body; an actuation button pivotally supported by the body; an electrical circuit portion underlying the actuation button; an elastomeric portion overlying the electrical circuit portion, the elastomeric portion having at least one active collapsible dome formed therein for providing a connection on the electrical circuit portion when the dome is in a collapsed position and comprising at least one passive collapsible dome formed therein for providing tactile feedback during operation of the actuation button without operating on the electrical circuit portion; and a plunger element supported by the body between the actuation button and the elastomeric portion, the plunger element comprising a first upwardly directed portion bearing against the actuation button such that movement of the actuation button causes the plunger element to move towards the elastomeric portion, a second downwardly directed portion aligned with the active collapsible dome such that the movement of the actuation button beyond a predetermined threshold causes the plunger element to collapse the elastomeric dome, and a third downwardly directed portion aligned with the passive collapsible dome such that the movement also causes the plunger element to collapse the elastomeric dome.

BRIEF DESCRIPTION OF THE DRAWINGS

An embodiment of the invention will now be described by way of example only with reference to the appended drawings wherein.

DETAILED DESCRIPTION OF THE DRAWINGS

It has been recognized that due to the repeated use of an electric switch assembly that utilizes elastomeric domes for actuating the switch, and from experiencing abnormal loads or other misuse, the elastomeric domes can experience premature deterioration or even failure. To inhibit such loads and misuse and to encourage consistent loading of the elastomeric domes, a switch assembly of the type utilizing an elastomeric portion may be configured to restrict or limit movement of the moveable components. It has also been found that restricting relative movement of the components can minimize rattling due to vibration of the switch assembly without requiring additional components to fix them in place.

The elastomeric pad comprises one or more collapsible domes that are positioned such that a plunger element supported by the switch assembly collapses the domes when an actuation button is tilted. The plunger element, in one aspect, may have a limiting mechanism to limit downward movement of the plunger element such that the collapsible domes are not overloaded. The body and plunger may also be formed with complementary profiled portions that restrict any one or more of fore/aft, side-to-side and up/down movements of the plunger with respect to the body to prevent abnormal loading on the collapsible domes to increase the lifecycle of the elastomeric portion and to minimize rattling of the plunger element within the body of the switch assembly.

It has also been recognized that both single position and dual position switches can be interchanged by modifying certain ones of the elastomeric domes such that they are passive thus enabling the same switch assembly to be used for both double and single detent operations by simply replacing the elastomeric portion with one having such passive domes.

Figure 1:
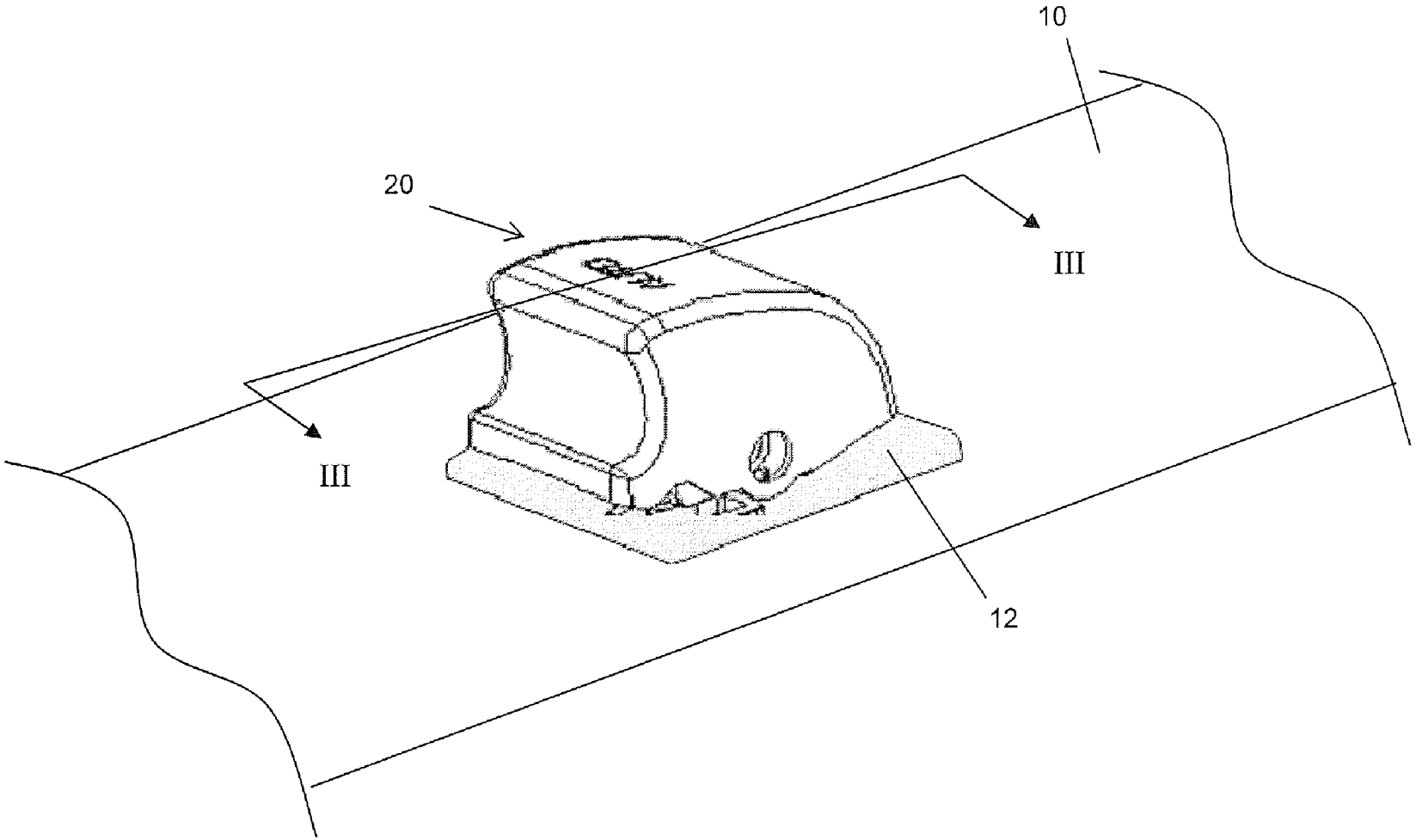
FIG. 1 is a partial perspective view of a control console in the interior of an automobile comprising an electrical switch assembly.

Turning now to the figures, FIG. 1 illustrates a control console 10 in the interior of a vehicle that supports and houses a switch assembly 20 by exposing a portion thereof through an aperture 12. The control console 10 may be located on a door, central console or any other portion of the vehicle where a switch assembly 20 is to be located.

Figure 2:
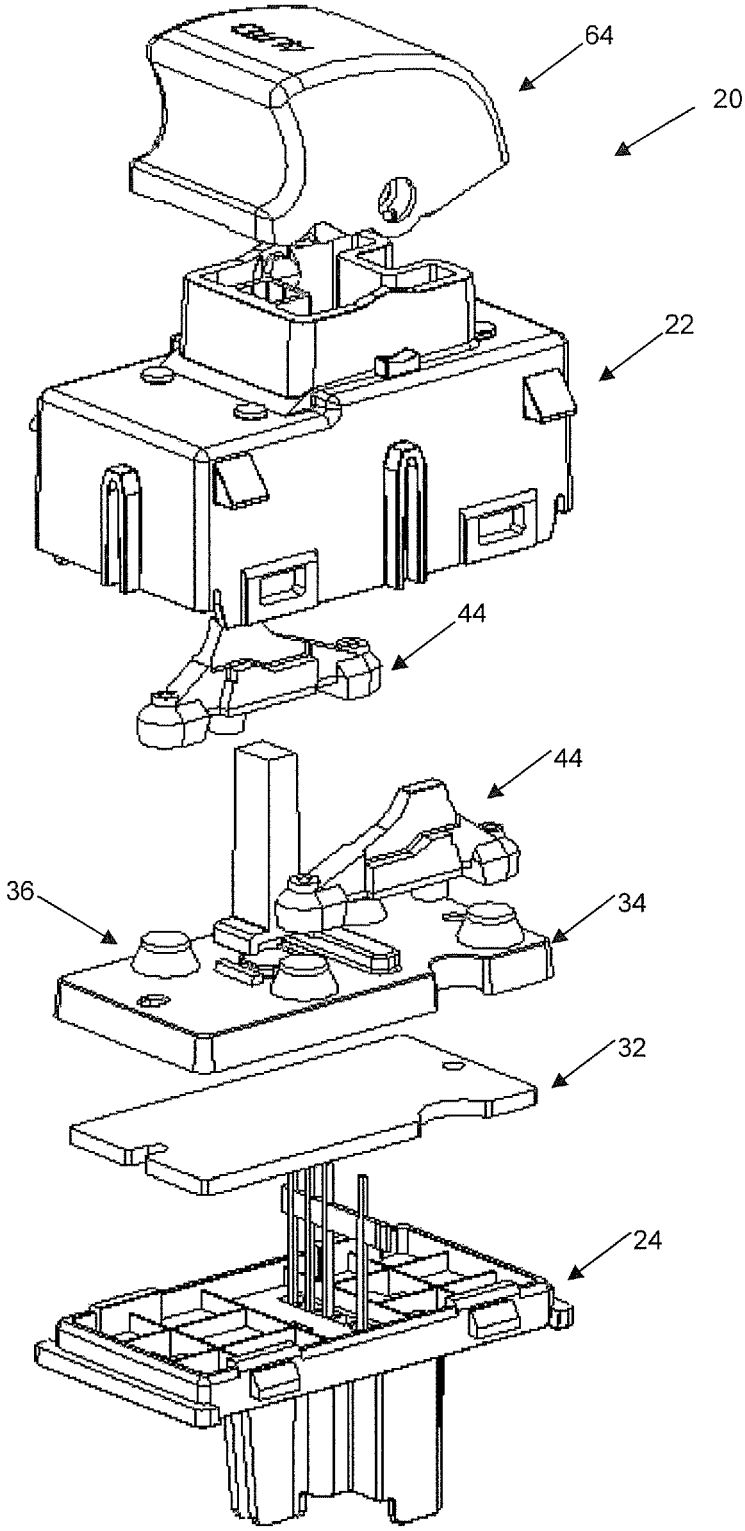
FIG. 2 is an exploded perspective view of the window switch assembly shown in FIG. 1.

FIG. 2 shows an exploded assembly view of the switch assembly 20. For the purpose of clarity, a limited number of reference numerals are shown in FIG. 2, which refer only to the components that are, in this embodiment, assembled to provide the switch assembly 20. It can be seen that the switch assembly 20 is comprised of a base portion 24 that provides an interface to an electrical connector or harness (not shown) for interfacing with vehicle's electrical system. The base 24 supports a printed circuit board (PCB) 32, which in turn supports an overlying elastomeric portion 34. The elastomeric portion 34 comprises, in this example, a set of four collapsible elastomeric domes 36, which are pressed and collapsed during operation of the switch assembly 20 to in turn operate on the PCB 32 as will be explained in greater detail below. The switch assembly 20 also comprises a main body 22, which acts as a shroud or covering for the elastomeric portion 34, the PCB 32 and any connections between the PCB 32 and the base 24. The body 22 also locates a pair of plunger elements 44 such that they are aligned with respective ones of the elastomeric domes 36.

The plunger elements 44 are operated on by a tiltable actuation button, commonly referred to as an actuator knob 64. Where the switch assembly 20 is used for controlling a vehicle window, the actuator knob 64 may also be referred to as a window knob The actuator knob 64 is rotatably supported atop the body and during movement thereof operates the plunger elements 44. It can be seen that the plunger elements 44 are oppositely directed and as will be explained below, one will operate upon a forward tilt (downward push) of the actuator knob 64 while another will operate upon a rearward tilt (upward pull) of the actuator knob 64. In general, both plunger elements 44 operate in a similar manner and thus the operation of only one needs to be described in detail.

Figure 3:
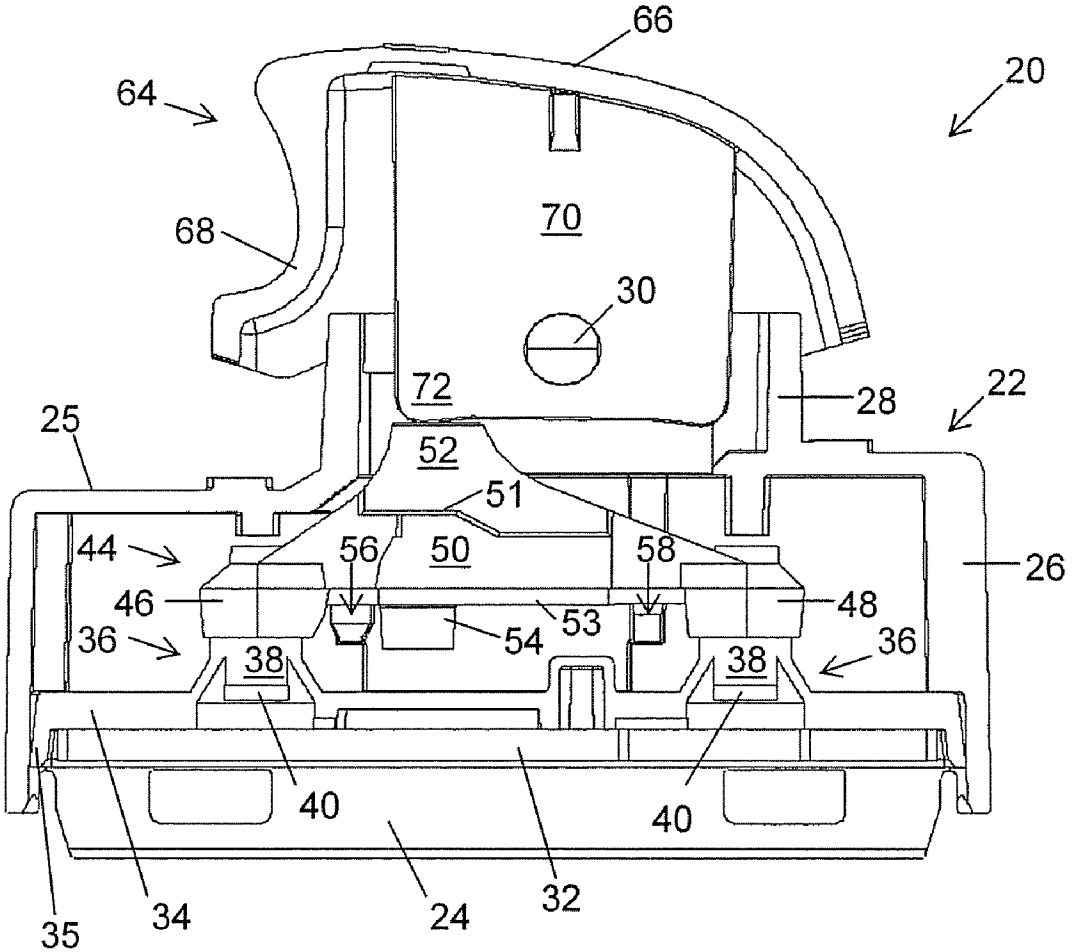
FIG. 3 is a sectional view of the switch assembly along the line III-III shown in FIG. 1 in a neutral position.

Turning now to FIG. 3, a sectional view along the line III-III in FIG. 1 is shown. FIG. 3 illustrates a neutral position for the switch assembly 20 and shows the interaction of the components shown in FIG. 2, when the switch assembly 20 is assembled. It can be seen in FIG. 3 that the body 22 covers the plunger element 44, the elastomeric portion 34 and the PCB 32 for protection and to facilitate the interactions between and movements of the components. The body 22 comprises a top portion 25 configured to include an upstanding, open ended post 28 that provides a pivot pin 30 on each side (see FIG. 2) for pivotally attaching the actuator knob 64. The body 22 fits over the base 24 while securing the elastomeric portion 34 over the PCB 32. The elastomeric portion 34 includes a downwardly extending skirt 35 that fits between the edge of the PCB 32 and the body 22 when assembled as shown in FIG. 3.

The collapsible domes 36 are also shown in greater detail in FIG. 3. The domes 36 comprise a centrally positioned, inwardly and downwardly directed actuator 38 with a contact 40 affixed to the lower end thereof. The domes 36 also include a collapsible annular ring 35 (see also FIG. 14) of elastomeric material connecting the actuator 38 to the base of the elastomeric portion 34 that when collapsed causes downward movement of the actuator 38 and contact 40 towards the PCB 32, such that the contact 40 may engage an underlying portion of the PCB 32. In the neutral position shown in FIG. 3, the plunger element 44 is seated atop a pair of domes 36, with a frontward foot 46 aligned with a frontward dome 36 and a rearward foot 48 aligned with a rearward dome 36, where in this example, the frontward direction is towards the left, i.e. the "front" of the switch assembly 20.

The frontward foot 46 and rearward foot 48 are separated by a lower body portion 50 that extends between the feet 46, 48. The lower body portion 50 is separated from an upper body portion 52 by a ridge 51 that provides a substantially upwardly facing surface for bearing against a portion of the body 22 during assembly as will be explained below. The lower body portion 50 is profiled to include a frontward vertically oriented passage or slot 56 and a rearward vertically oriented passage or slot 58. The slots 56, 58 are included to accommodate complementary profiled portions of the body 22 for restricting movement of the plunger element 44 as will be explained below.

It can be seen that in the configuration shown in FIG. 3, the upper body portion 52 is offset towards the frontward foot 46 and frontward slot 56 such that it is aligned with a cam 72 formed in an extension 70 extending from the underside of the actuator knob 64. In this way, tilting the actuator knob 64 translates into movement of the cam 72 against the upper body portion 52 thus forcing movement of the plunger element 44 according to the profile of the cam 72. The plunger element 44 also comprises a downwardly extending limiting mechanism, which in this embodiment is a post 54 aligned with the cam 72 and upper body portion 52 along the line of action of the actuator knob 64. The post 54 is sized so as to not interfere with the collapsing of the domes 36 but to ensure that the plunger element 44 does not overload the domes 36 by overstressing the collapsible rings 35. As discussed further below, the post 54 avoids the need to fix the plunger element 44 to the body 22 thus decreasing the number of components and the time for assembly.

The actuator knob 64 is rotatably supported by the upstanding post 28 using the pair of inwardly extending pins 30 that fit through corresponding holes of a pair of extensions 70 (i.e. one for acting on each plunger element 44). The actuator knob 64 has a profiled outer shell that comprises a front curved portion 68 and an upper curved portion 66 integrally formed to provide an ergonomic feel for the user. The actuator knob 64 is profiled so that it may be pressed on the upper portion 66 to effect a frontward tilt and pulled using the front portion 68 to effect a rearward tilt.

Figure 4:
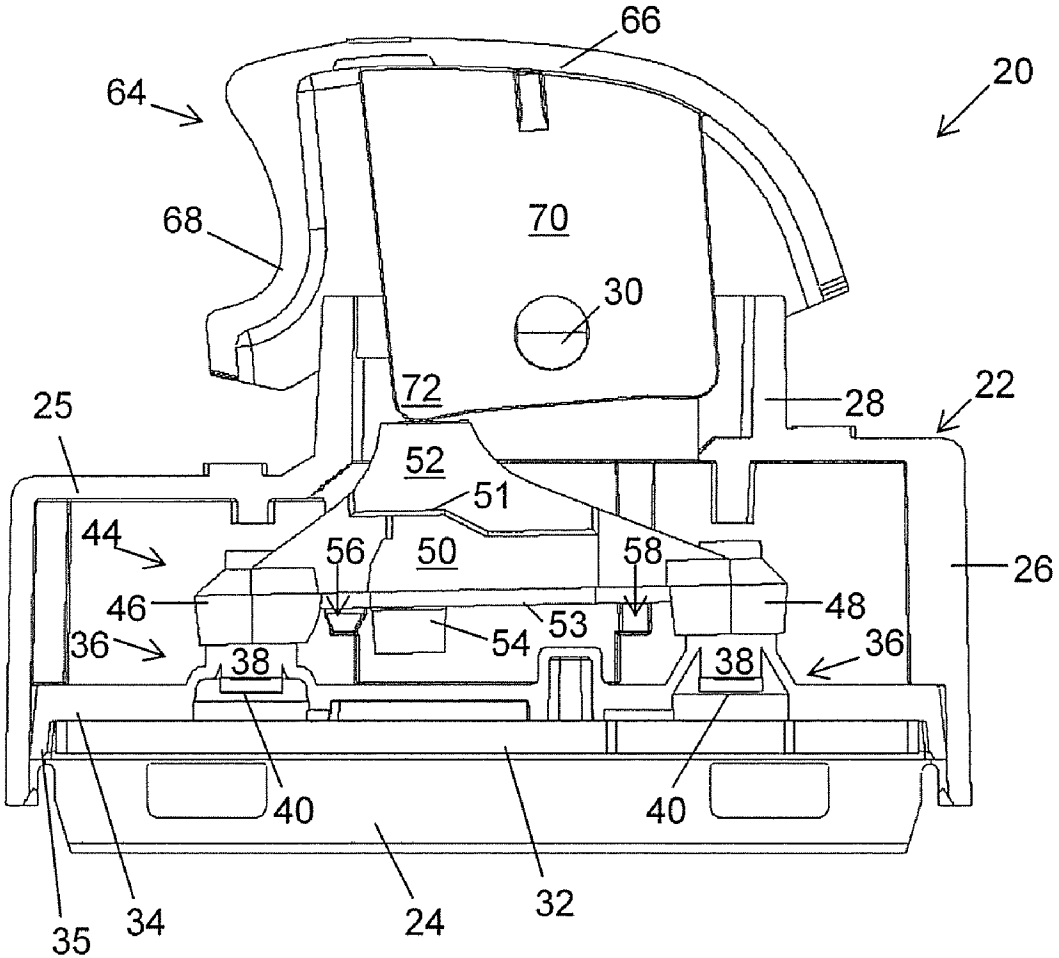
FIG. 4 is a sectional view of the switch assembly showing a manual operation position.
Figure 5:
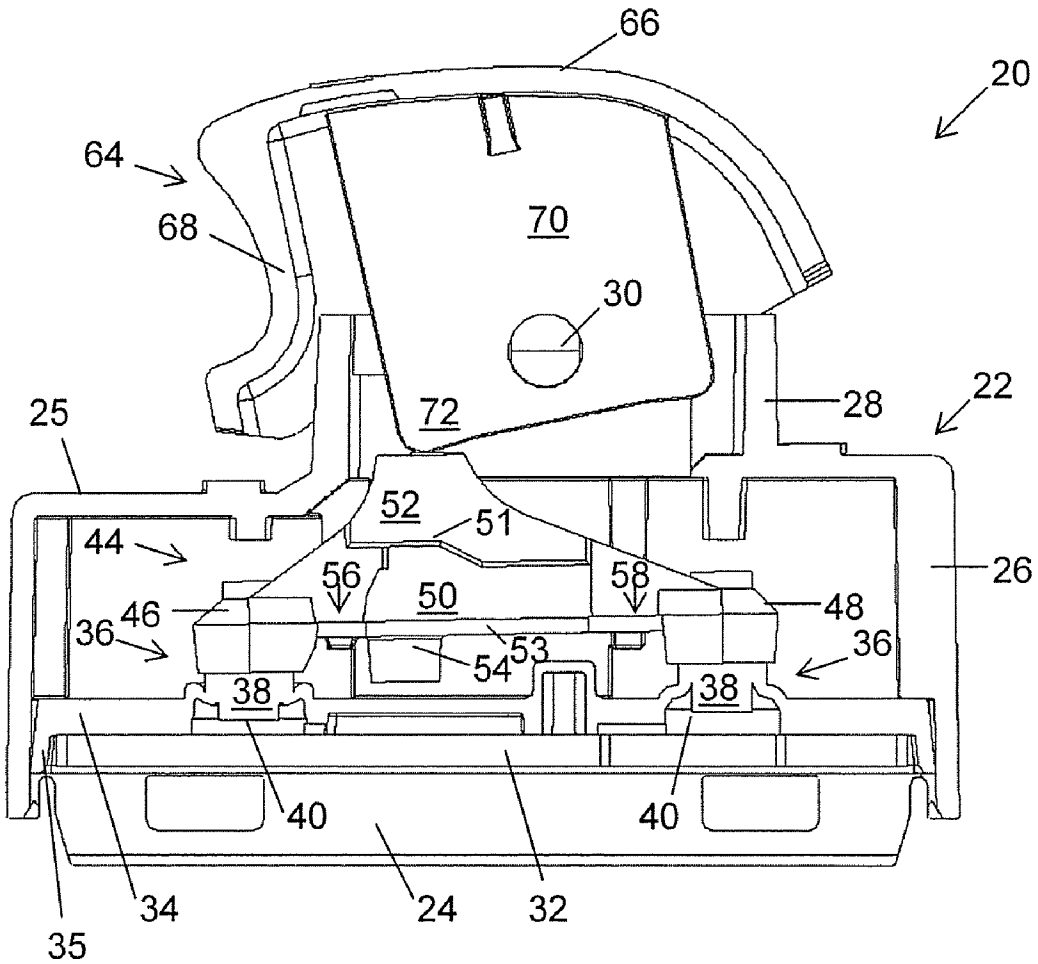
FIG. 5 is a sectional view of the switch assembly showing a transitional position.
Figure 6:
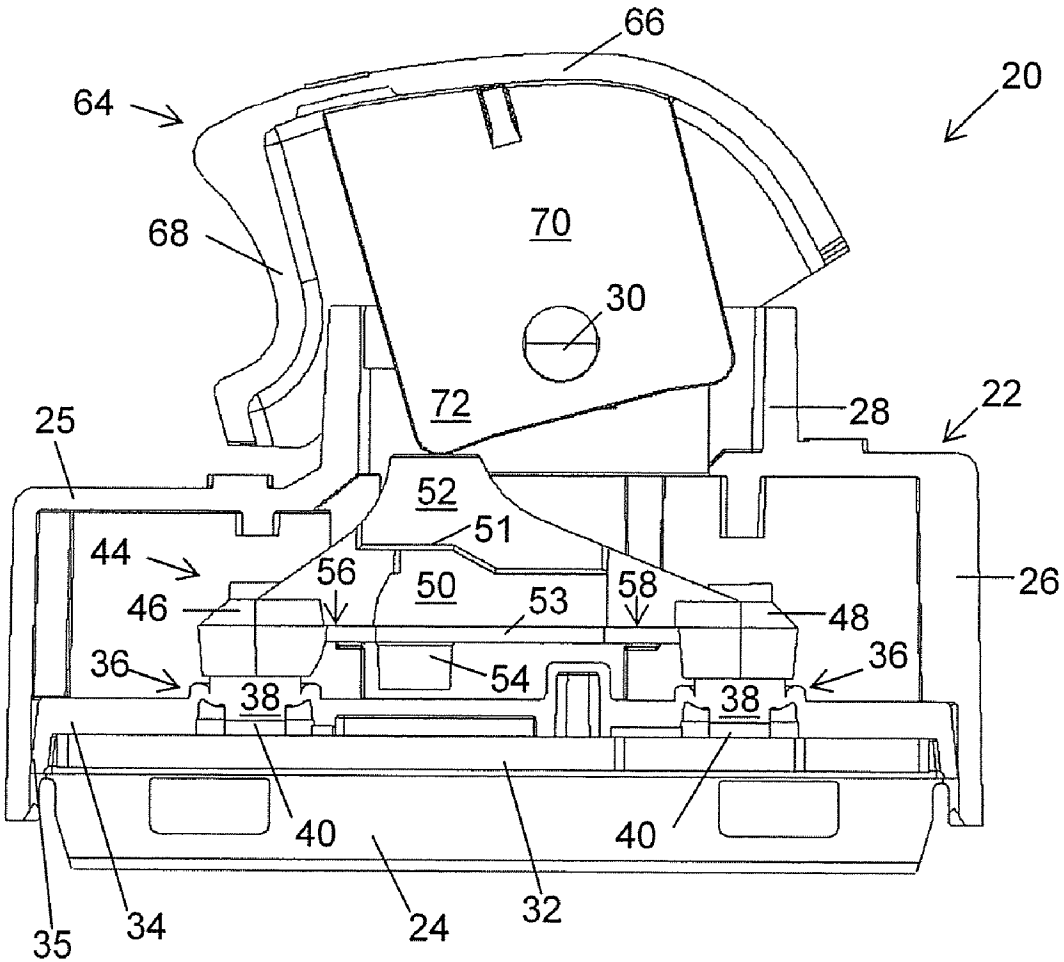
FIG. 6 is a sectional view of the switch assembly showing an automatic operation position.

The operation of the switch assembly 20 will now be described making reference to FIGS. 4 through 8, which also illustrates the overload protection provided by the post 54. FIG. 4 illustrates a first operating position that is often referred to as a "snap over" point wherein the collapsible ring 35 of the forward dome 36 begins to collapse and where the user would experience a maximum opposing force and tactile feedback. This is caused by frontward tilting of the actuation knob 64 about the pin 30 a certain distance which causes the cam 72 to roll over the upper body portion 52 of the plunger element 44, which in turn pushes the forward foot 46 in a generally downward direction. Following the snap over point shown in FIG. 4, the dome 36 fully collapses and the contact 40 engages the underlying portion of the PCB 32 thus initiating the first operating mode. In this example, it is assumed that the switch assembly 20 is used for a power window in a vehicle and the first operating mode is the manual "open window" or "window down" mode. It can be seen in FIG. 5 that the snap over point for the rear dome 36 occurs roughly at the same time as the initiation of the first operating mode because the collapse of the frontward dome 36 causes the entire plunger element 44 to move in a downward direction. As the cam 72 rolls over the upper body portion 52, the rear foot 48 begins to move the rear dome 36 past its snap over point to a second operating position wherein the contact 40 on the rear dome 36 engages the PCB 32 to initiate the second operating position as shown in FIG. 6. In this example, the second operating position provides automatic window movement such that the window continues to lower until it is fully opened. It can be appreciated that in the opposite direction, the automatic setting will cause the window to automatically close until fully closed.

Figure 7:
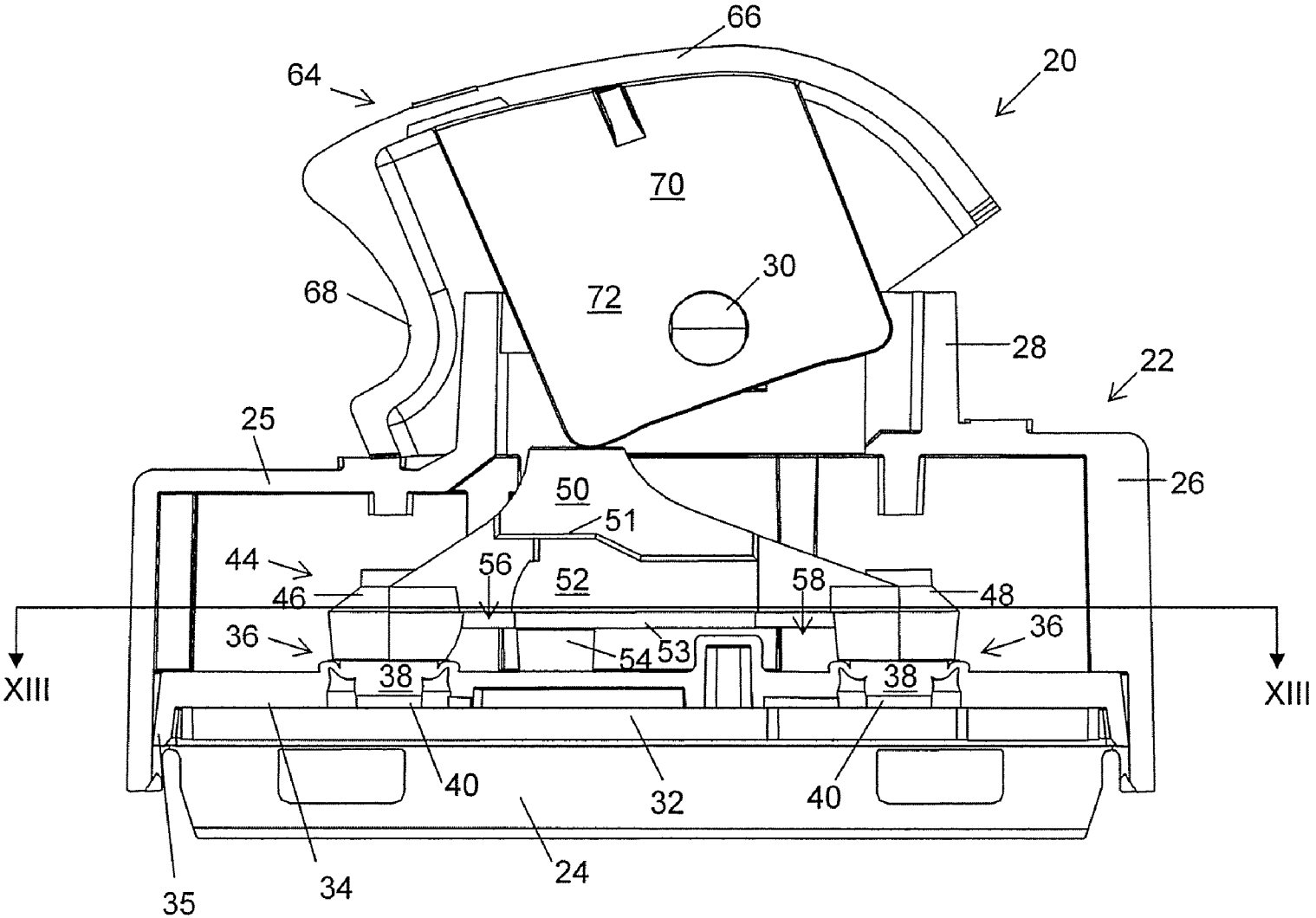
FIG. 7 is a sectional view of the switch assembly showing a full travel position.
Figure 8:
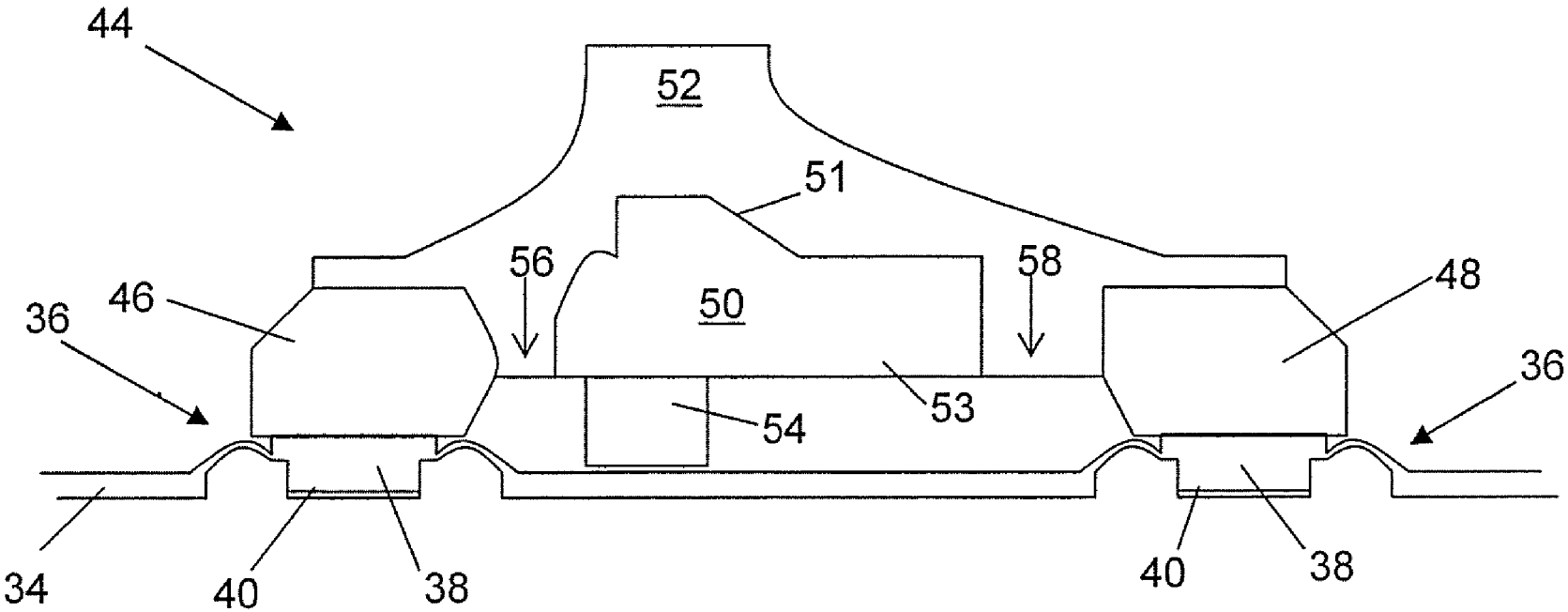
FIG. 8 is a profile view of the plunger element and a portion of the elastomeric portion shown in FIG. 7.

Turning now to FIG. 7, it can be seen that full travel of the actuation knob 64 will continue to compress the domes 36. To avoid overloading the domes 36 when in this position, the post 54 is located between the plunger body 50 and the elastomeric portion 32 to limit further downward movement of the plunger element 44. This prevents abnormal loads that may cause unwanted shear stresses in the rings 35, which could cause premature failure. FIG. 8 shows the plunger element 44 and elastomeric portion 34 in isolation to illustrate the relative sizing and configuration of the post 54, feet 46, 48 and lower body portion 50. It can be seen that the post 54 resists further downward movement of the feet 46, 48 whilst not interfering with the collapsing of the domes 36. In this example, the post 54 is generally aligned with the cam 72 and upper body portion 52 such that it is along the line of action during operation. This configuration is used to balance the plunger element 44 with respect to the elastomeric portion 34 to avoid abnormal loads that impose shear forces on the domes 36.

As shown in FIG. 2, another plunger element 44 is included in the switch assembly 20, which is used to operate the switch assembly 20 in the opposite direction, e.g. to raise or close a vehicle window. The other plunger element 44 operates in the same way and thus details thereof need not be reiterated. It may be noted however that the actuating knob 64 comprises another extension 70 with a corresponding cam 72 for engaging an upper body portion 52 of the other plunger element 44.

Figure 9:
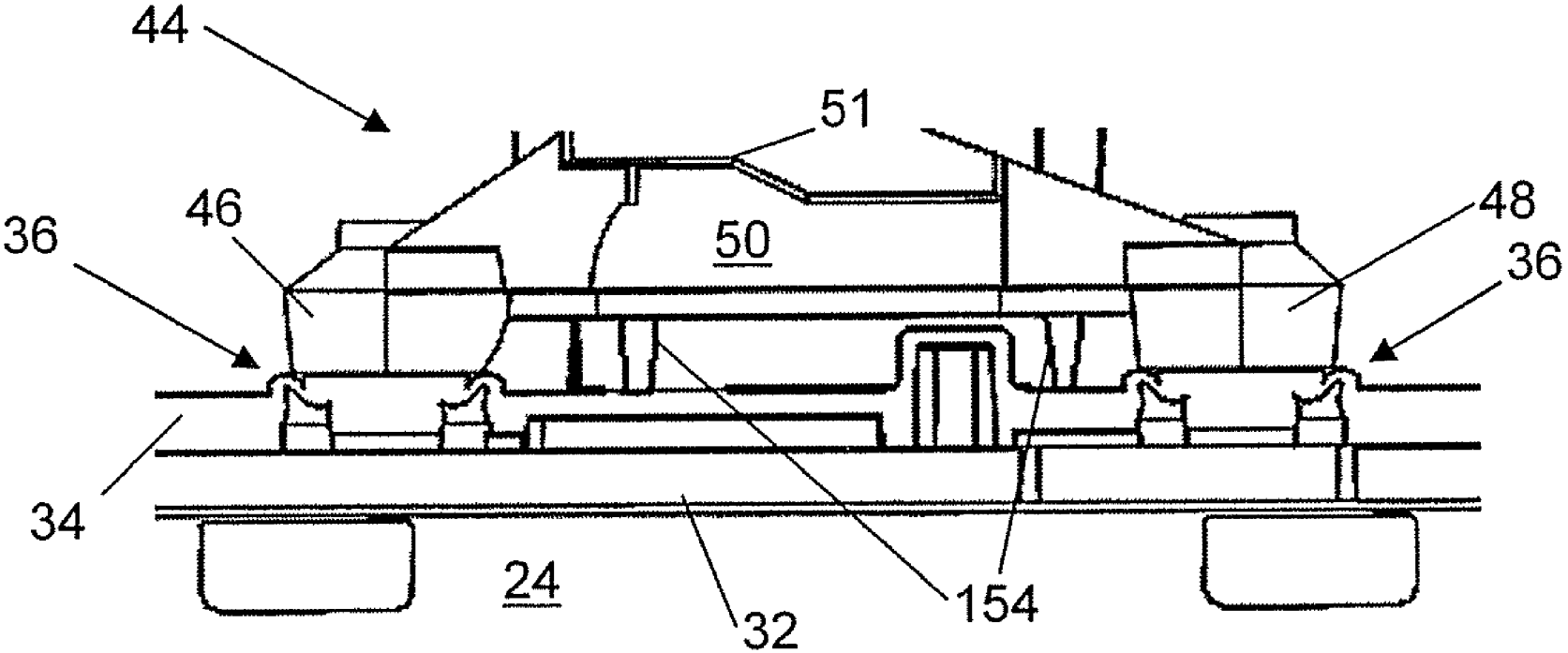
FIG. 9 is another embodiment of the lower limiting mechanism shown in FIG. 8.
Figure 10:
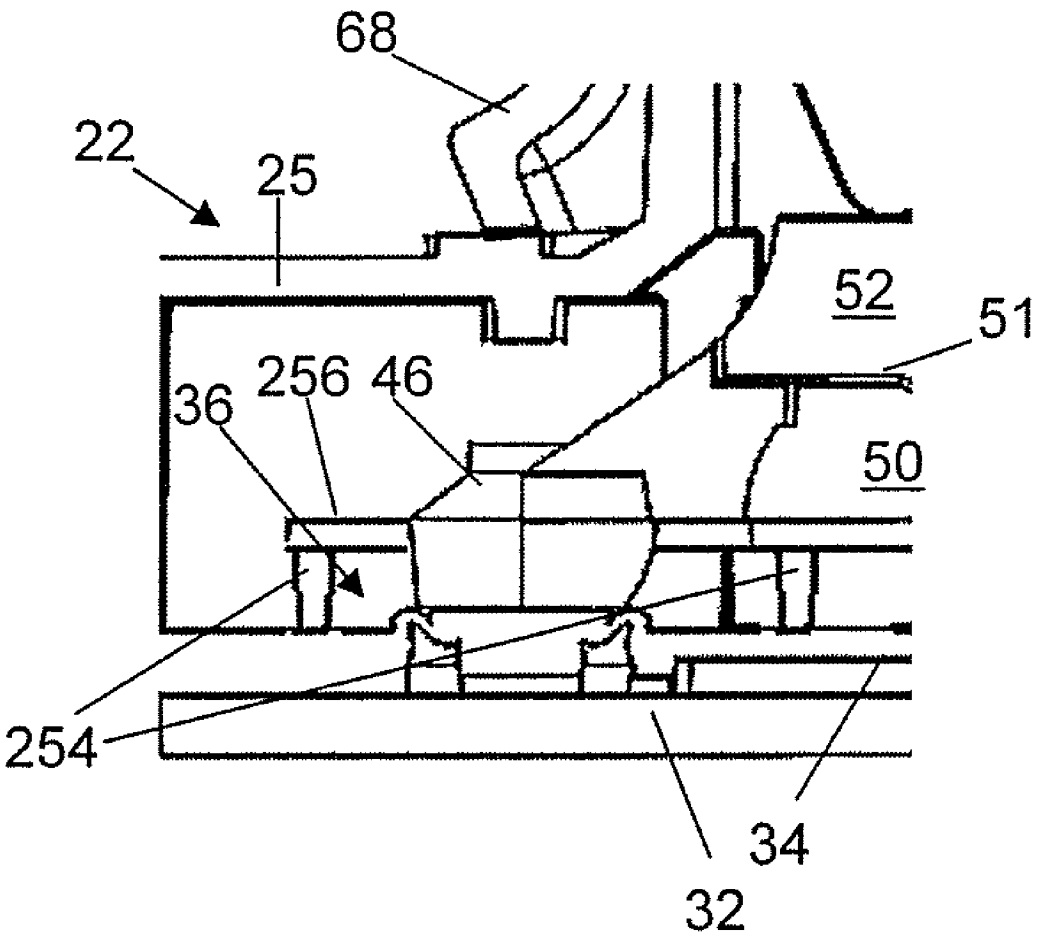
FIG. 10 is yet another embodiment of the lower limiting mechanism shown in FIG. 8.

The post 54 shown in FIGS. 2-8 is only one embodiment for providing a downward limiting mechanism between the plunger element 44 and the elastomeric portion 34. FIG. 9 illustrates another embodiment, wherein the limiting mechanism comprises a pair of downwardly extending ribs or blades 154 that are spaced along the lower edge 53 of the plunger element 44. In FIG. 9, a pair of blades 154 are spaced between the feet 46, 48 to balance the plunger element 44, however, greater than or fewer than two blades 154 may be used depending on the cost and space constraints. FIG. 10 illustrates another embodiment, wherein the limiting mechanism comprises a pair of blades 254 flanking at least one but preferably both of the feet 46, 48. The exterior ones of the blades 254 would require an extension support 256 for locating blades 254 away from the ends of the plunger element 44. Although the limiting mechanism is shown as being part of the plunger element 44 in these examples it will be appreciated that the limiting mechanism may be formed as part of the elastomeric portion 34 or body 22, e.g. as an upstanding post, rib or other protrusion on the elastomeric portion 34 or a horizontal protrusion from the body 22. However, it may be noted that since the elastomeric material is softer than a plastic, which would typically be used to construct the plunger element 44, including the limiting mechanism with the elastomeric pad 34 may be less effective. Similarly, a horizontal protrusion on the body 22 needs to avoid interfering with the plunger element 44 and operation of the elastomeric portion 34. It can thus be appreciated that the limiting mechanism may generally comprise any extension or interfering element attached to or part of any one of the plunger element 44, the elastomeric portion 34, and the body 22 or other component, which is capable of interfering with movement of the plunger element 44 with respect to the elastomeric portion 34 beyond a threshold to avoid overloading the domes 36.

Abnormal and extraneous forces applied to the domes 36 can occur not only from overloading in a downward direction, but also from movement of the plunger element 44 relative to the other components of the switch assembly 20. Such relative movements can also cause the plunger element 44 to rattle within the body due to vibration of the switch assembly 20, e.g. while driving a vehicle, which is undesirable. The vibration and the resulting rattle can be minimized by fixing the plunger element 44 using a pin or other mechanism. As noted above, this would also inhibit overloading. However, fixing the plunger element 44 increases the number of components required in the switch assembly 20 and increases the assembly time. Therefore, rather than fix the plunger element 44 to the body 22, it has been found that the body 22 and plunger element 44 can be configured to locate and guide movement of the plunger element 44 within the body 22.

Relative movement of the plunger element can be in the fore and aft directions as well as the side to side directions and can cause uneven loading to one side of the domes 36 resulting in shear forces or even torsional forces being applied to the domes 36. It has been found that the domes 36 can withstand prolonged and repeated use when operated properly, namely when collapsed in a generally vertical direction with minimal strain in other directions. To restrict fore and aft movements of the plunger element 44, the profile of the plunger element 44 provided by the slots 56, 58 is used to locate the plunger element 44 within the body 22 by interacting with complimentary profiled portions on the body 22.

Figure 11:
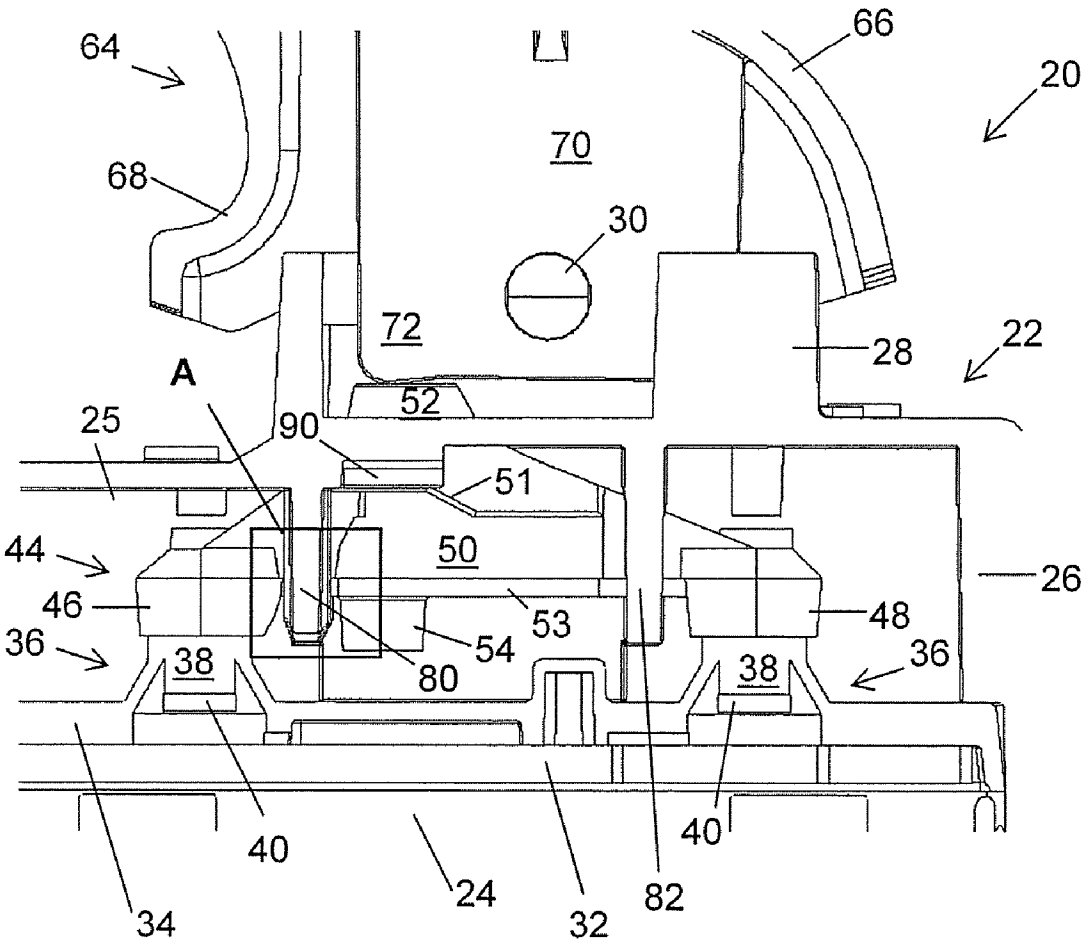
FIG. 11 is a sectional view of the switch assembly showing the interaction between the plunger element and the body for limiting fore and aft movements.
Figure 12:
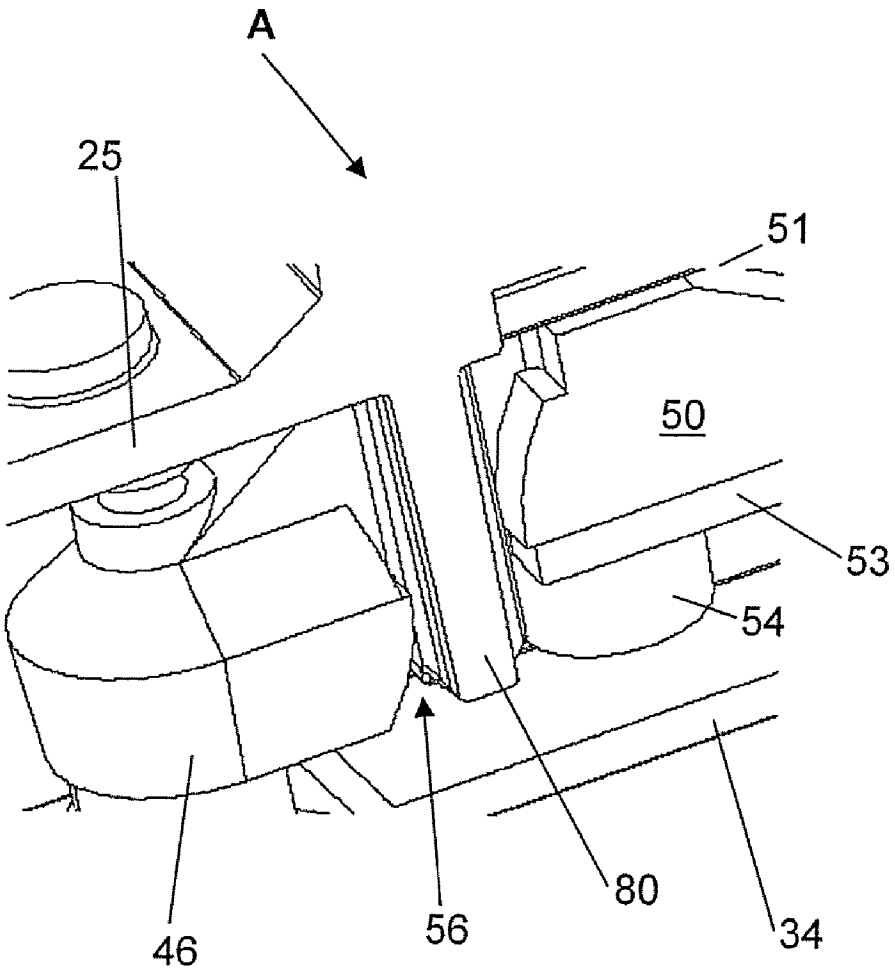
FIG. 12 is a partial perspective view showing portion A identified in FIG. 11.

In one embodiment, shown in FIG. 11, a first tab or rib 80 extends downwardly from the top portion 25 of the body 22 through the frontward slot 56 and a second rib 82 extends downwardly from the top 25 of the body 22 through the rearward slot 58. FIG. 12 shows an enlarged view of portion A shown in FIG. 11, which illustrates the interaction of the rib 80 and the frontward slot 56. It can be seen that the ribs 80, 82 guide the plunger element 44 in a generally vertical direction as it is moved by the actuator knob 64. The relative fore and aft movements are restricted according to the tolerances between the ribs 80, 82 and the slots 56, 58. In the arrangement shown in FIG. 11, the tolerance between the frontward rib 80 and frontward slot 56 is less than that of the rearward rib 82 and rearward slot 58 since the frontward foot 46 actuates prior to the rearward foot 46 on an offset fulcrum which imparts a slight arcuate path on the rearward foot 48 as it actuates the rearward dome 36. The arcuate path thus requires more room for movement of the rearward slot 58 around the fixed rib 82. It may be noted that the ribs 80, 82 are also useful in guiding and locating the plunger element 44 in the body 22 during assembly of the switch assembly 20.

Figure 13:
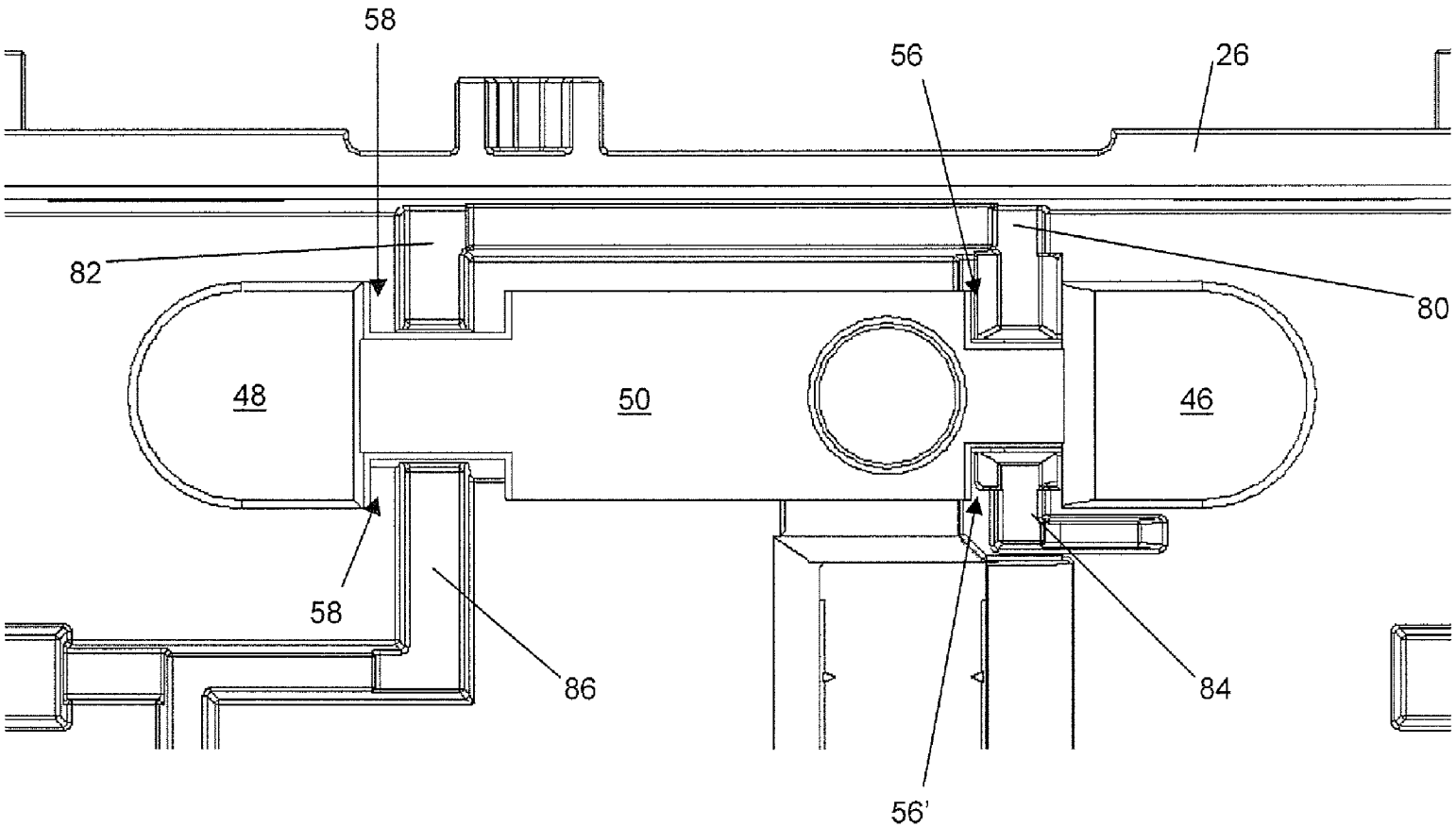
FIG. 13 is a sectional plan view along the line XIII-XIII in FIG. 7, showing the interaction between the plunger element and the body for limiting side-to-side movements.

In addition to restricting fore and aft movements, it has been found that by providing similar slots 56' and 58' on the opposite side of the plunger element 44 as shown in FIG. 13, side to side movements can also be restricted to further reduce the likelihood of abnormal stresses on the domes 36 and rattling of the plunger element 44 against the body 22. It can be seen in FIG. 13 that a further frontward rib 84 extends through the opposite frontward slot 56' and a further rearward rib 86 extends through the opposite rearward slot 58'. By providing the four slots 56, 56', 58 and 58', the lower body portion 50 is tapered at its connection to each foot 46, 48. Similar to the ribs 80, 82, the additional ribs 84, 86 further guide the plunger element 44 into place during assembly.

Figure 14:
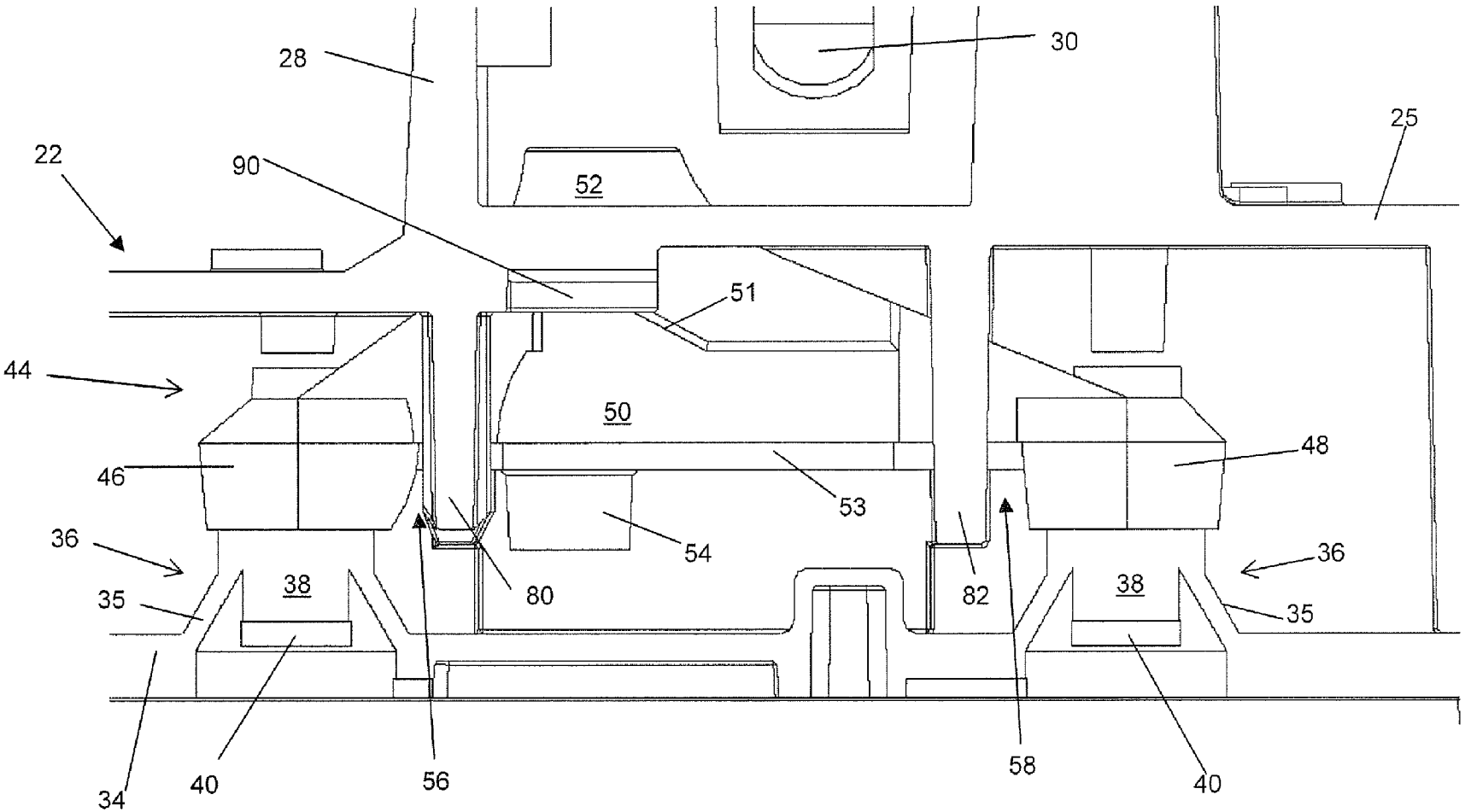
FIG. 14 is an enlarged view of the interactions shown in FIG. 11.

As discussed above, the transition between the lower body portion 50 and the upper body portion 52 of the plunger element 44 defines a ridge 51. The ridge 51 can be formed on both sides of the plunger element 44, similar to the provision of opposite slots 56/56' and 58/58'. The ridges 51 can be used to further locate the plunger element 44 in the body both during operation and during assembly, by engaging a pair of upper ribs 90 as shown in FIG. 14. It will be appreciated that one rib 90 and ridge 51 combination may be used instead of a pair of ribs 90 and ridges 51.

It has been noted that the plunger element 44, during operation, is operated through the interface of the cam 72 and the upper body portion 52. As such, upward movement of the plunger element 44 is normally restricted by the actuation knob 64. However, the cam 72 only bears against the upper body portion 52 when the actuator knob 64 is being tilted forward or in the neutral position. As can be seen in FIG. 2, another plunger element 44 may be used to provide a similar switching sequence in the opposite direction, e.g. to raise or close a car window. When operated in the opposite direction, the cam 72 would no longer engage the plunger element 44 as shown in FIGS. 3-7. Although the plunger element 44 is prevented from escaping the body 22, vertical movement of the plunger element 44 can also cause a rattling sound in the switch assembly 20, which as discussed above is generally undesirable. To inhibit rattling caused by up and down vibration of the plunger element 44 when not in use, the upper ribs 90 keep the plunger element 44 seated in the neutral position atop the elastomeric portion 34 as shown in FIG. 3.

It can therefore be seen that the plunger element 44 can be more conveniently assembled in the body 22 by restricting movement of the plunger element 44 rather than fixing the plunger element 44 to the body 22. The restricted movement of the plunger element 44 not only prevents undesirable stresses and overloading of the domes 36 by controlling movement of the plunger element 44 with respect to the elastomeric portion 34, but also reduces rattling noises caused by vibration of the switch assembly 20. In general, the movement of the plunger element 44 is restricted by providing complementary interacting profiled portions of the body 22 and the plunger element 44, e.g. by way of ribs, slots and ridges as described above.

Referring again to FIG. 2, to assemble the switch assembly 20, the body 22 may first be overturned so that the post 38 is facing down. The plunger elements 44 may then be guided into position by ensuring the ribs 80, 82, 84, 86 slide through the slots 56, 56', 58, 58'. The ridges 51 will also be seated against the upper ribs 90. The elastomeric portion 54 may then be inserted into the body such that the domes 36 are aligned with the plunger elements 44 and then the PCB 32 inserted such that it is contained by the skirt 35. Alternatively, the elastomeric portion 34 and PCB 32 can be fit together first and then inserted if desired. This secures the plunger elements 44 between the elastomeric portion 34 and the body 22 and requires no further positioning of the plunger elements 44. The base 24 may then be connected to the body 22 and the PCB 32 to complete the assembly. It will be appreciated that fasteners and other retaining mechanisms such as screws and clips may be used to secure the PCB 32 to the body 22 and to connect the body 22 to the base 24. The actuator knob 64 may then be snapped into place by aligning the holes in the actuator knob 64 with the corresponding pins. Alternatively, the actuator knob 64 may be attached to the base at the beginning of the assembly process. As can be seen in FIG. 2, the post 28 can be given a profile that distinguishes the frontward end from the rearward end to assist in orienting the actuator knob 64.

The switch assembly 20 shown in FIGS. 2-14 and described above operates in a "double-detent" fashion by utilizing the collapse of a pair of domes 36 in succession to provide two switching stages. Similar switch assemblies may require only a single stage or "single-detent" operation, e.g. one providing manual window operation only. It has been found that the body 22, plunger element 44 and actuator knob 46 used for a double-detent operation can also be used for a single-detent operation by interchanging certain ones of the "active" elastomeric domes 36 (i.e. those having contacts 40) with "passive" elastomeric domes 136 (i.e. dummy domes that do not operate the PCB 32) and thus only requiring replacement of the elastomeric portion 34 to provide different switching configurations. As such, a simple replacement of the elastomeric portion 34 changes the switch assembly 20 from a double-detent switch to a single-detent switch. In one example, the frontward dome 36 remains the same while the rearward dome 36 is interchanged with a passive dome 136. A comparison between the active domes 36 and passive domes 136 in a neutral position is shown in FIGS. 15(*a*) and 15(*b*) respectively.

Figure 15:
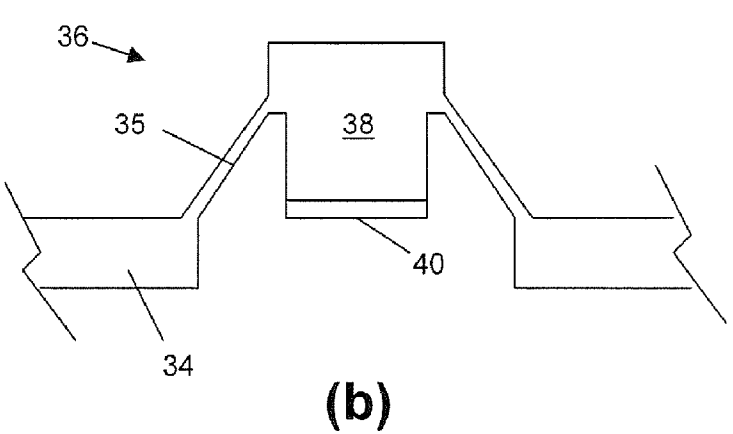
FIGS. 15(*a*) and 15(*b*) illustrate an active collapsible dome and a passive collapsible dome in a neutral position.
Figure 15:
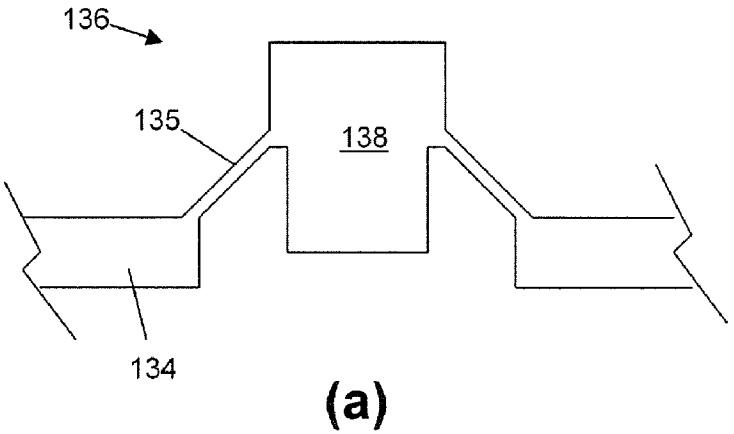

As can be seen in FIG. 15, the passive dome 136 is generally similar in structure to the active dome 36 but includes modified proportions to provide no perceivable snap feel to the dome 136 commonly referred to as a "zero tactile ratio". Mechanically, this can be described as where there is no inflection of the force/displacement curve of the dome 136. This permits an increased travel of the actuator knob 46 than if only one active dome 36 were used and does not include a snap-like feel when compared to an active dome 36. The passive dome 136 comprises an elongated actuator 138 when compared to the actuator 38 and does not utilize a contact 40. The annular ring 135 in the passive dome 136 may be less angled with respect to the pad 134 towards the actuator 138 and such angle can be varied to achieve the zero tactile ratio. Also, since the actuator 138 is elongated, it should collapse less abruptly than the active dome 35, which masks the presence of the passive dome 136, i.e. removes the snap feel.

Figure 16:
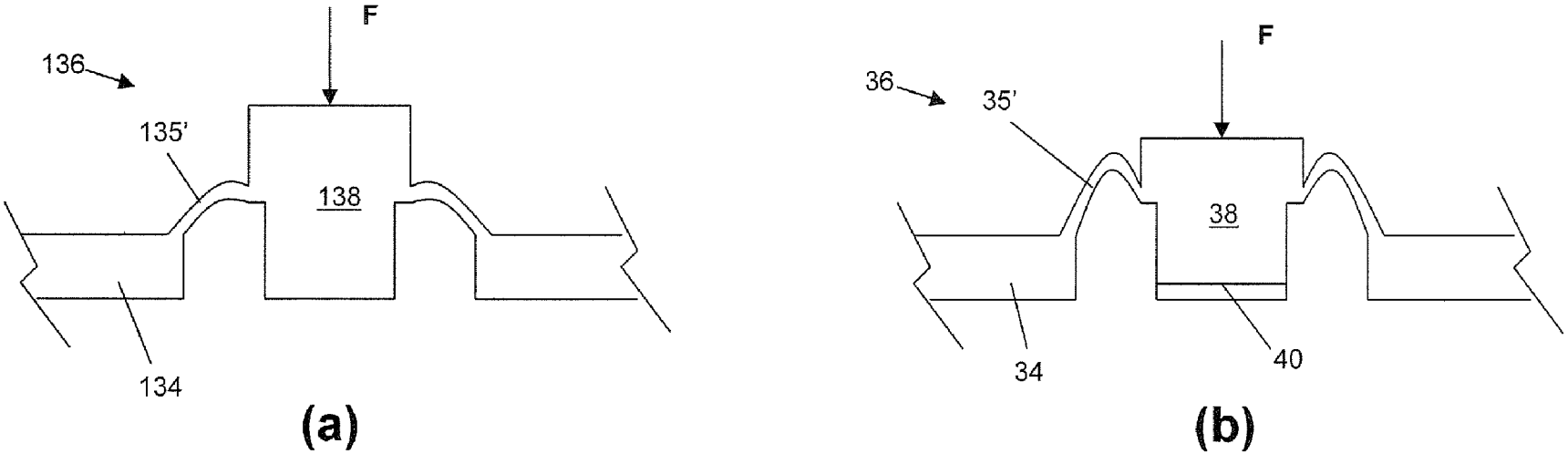
FIGS. 16(*a*) and 16(*b*) illustrate the active collapsible dome and the passive collapsible dome in a collapsed position.

The collapsed positions are shown in FIGS. 16(*a*) and 16(*b*). In operation, the application of a first force F causes the active dome 36 to collapse, and the passive dome 136 to give way to permit additional travel of the plunger element 44. In this way, as noted above, the passive dome 136 should not provide any further snap feel to the switch's operation. The use of the passive dome 136 balances the load on the plunger element 44 while allowing the same switch assembly 20 described above to be used for providing a single-detent operation by simply replacing the elastomeric portion 34 with one comprising appropriately placed passive domes 136.

Although the invention has been described with reference to certain specific embodiments, various modifications thereof will be apparent to those skilled in the art without departing from the spirit and scope of the invention as outlined in the claims appended hereto.

The invention claimed is:

1. A switch assembly comprising:

a body;

an actuation button pivotally supported by said body;

an electrical circuit portion underlying said actuation button;

an elastomeric portion overlying said electrical circuit portion, said elastomeric portion having a pair of collapsible domes formed therein for providing respective connections on said electrical circuit portion when said domes are in collapsed positions;

a plunger element supported by said body between said actuation button and said elastomeric portion, said plunger element comprising a first upwardly directed portion bearing against said actuation button such that movement of said actuation button causes said plunger element to move towards said elastomeric portion, a second downwardly directed portion aligned with a first of said collapsible domes such that movement of said actuation button in a first direction beyond a first predetermined threshold causes said second downwardly directed portion to collapse said first of said elastomeric domes, and a third downwardly directed portion spaced from said second downwardly directed portion such that said first upwardly directed portion is aligned between said second and third downwardly directed portions, said third downwardly directed portion being aligned with a second of said collapsible domes such that movement of said actuation button in a second direction beyond a second predetermined threshold causes said third downwardly directed portion to collapse said second of said elastomeric domes; and a limiting mechanism extending downwardly from said plunger element between said second and third downwardly directed portions towards said elastomeric portion to restrict movement of said plunger element beyond a lower limit to protect overloading of said collapsible domes.

2. The switch assembly according to claim 1 wherein said limiting mechanism comprises a downwardly extending post extending beyond said second and third downwardly directed portions.

3. The switch assembly according to claim 1 wherein said limiting mechanism is aligned with said first upwardly directed portion along a line of action of said actuation button.

4. The switch assembly according to claim 1 wherein said limiting mechanism comprises one or more blades extending between said plunger element and said elastomeric portion.

5. A switch assembly comprising:

a body;

an actuation button pivotally supported by said body;

an electrical circuit portion underlying said actuation button;

an elastomeric portion overlying said electrical circuit portion, said elastomeric portion having at least one collapsible dome formed therein for providing a connection on said electrical circuit portion when said dome is in a collapsed position; and a plunger element supported by said body between said actuation button and said elastomeric portion, said plunger element comprising a first upwardly directed portion bearing against said actuation button such that movement of said actuation button causes said plunger element to move towards said elastomeric portion, a second downwardly directed portion aligned with said collapsible dome such that said movement of said actuation button beyond a predetermined threshold causes said plunger element to collapse said elastomeric dome, and at least one profiled portion for interacting with a complementary profiled portion on said body, one of said at least one profiled portion and said complementary profiled portion comprising a rib and the other of said at least one profiled portion and said complementary profiled portion comprising a slot, wherein said rib is positioned within at least a portion of said slot during movement of said plunger element and when said plunger element is at rest, to restrict both fore and aft and side-to-side movements of said plunger element.

6. The switch assembly according to claim 5 wherein said plunger element and said body comprise a first profiled portion and complementary profiled portion on a first side of said plunger element and a second profiled portion and complementary profiled portion on a second side of said plunger element.

7. The switch assembly according to claim 6 wherein said plunger element comprises a first pair of oppositely positioned profiled portions and complementary portions at a first end of said plunger element, and a second pair of oppositely positioned profiled portions and complementary portions at a second end of said plunger element.

8. The switch assembly according to claim 5 wherein said body comprises a vertical limiting mechanism for locating said plunger element in said body during assembly of said switch assembly.

9. A switch assembly comprising:

a body;

an actuation button pivotally supported by said body;

an electrical circuit portion underlying said actuation button;

an elastomeric portion overlying said electrical circuit portion, said elastomeric portion having at least one active collapsible dome formed therein for providing an electrical connection on said electrical circuit portion when said active collapsible dome is in a collapsed position during a first movement of said actuation button, and comprising at least one passive collapsible dome formed therein for providing tactile feedback during a second movement of said actuation button without activating a contact on said electrical circuit portion; and a plunger element supported by said body between said actuation button and said elastomeric portion, said plunger element comprising a first upwardly directed portion bearing against said actuation button such that movement of said actuation button causes said plunger element to move towards said elastomeric portion, a second downwardly directed portion aligned with said active collapsible dome such that said first movement of said actuation button causes said plunger element to collapse said active elastomeric dome, and a third downwardly directed portion aligned with said passive collapsible dome such that said second movement causes said plunger element to collapse said passive elastomeric dome.

10. The switch assembly according to claim 9 wherein said passive collapsible dome collapses under a force which is greater than that required to collapse said active collapsible dome.

11. A plunger element for a switch assembly having a body, an actuation button supported by said body above an elastomeric portion with at least a pair of collapsible domes, said plunger element to be supported by said body between said actuation button and said elastomeric portion, said plunger element comprising:

a first upwardly directed portion for bearing against said actuation button such that movement of said actuation button causes said plunger element to move towards said elastomeric portion;

a second downwardly directed portion to be aligned with a first of said collapsible domes such that movement of said actuation button in a first direction beyond a first predetermined threshold causes said second downwardly directed portion to collapse said first of said elastomeric domes;

a third downwardly directed portion spaced from said second downwardly directed portion such that said first upwardly directed portion is aligned between said second and third downwardly directed portions, said third downwardly directed portion to be aligned with a second of said collapsible domes such that movement of said actuation button in a second direction beyond a second predetermined threshold causes said third downwardly directed portion to collapse said second of said elastomeric domes; and a limiting mechanism extending downwardly from said plunger element between said second and third downwardly directed portions to restrict movement of said plunger element with respect to said elastomeric portion.

12. The plunger element according to claim 11 wherein said limiting mechanism is located between said plunger element and said elastomeric portion to restrict said movement beyond a lower limit to protect overloading of said collapsible dome.

13. The plunger element according to claim 11 wherein said limiting mechanism comprises a downwardly extending post protruding from said plunger element.

14. The plunger element according to claim 13 wherein said post is aligned with said first upwardly directed portion along a line of action of said actuation button.

15. The plunger element according to claim 11 wherein said limiting mechanism comprises one or more blades extending between said plunger element and said elastomeric portion.

16. The plunger element according to claim 11 wherein said limiting mechanism comprises at least one profiled portion for interacting with a complementary profiled portion on said body to restrict movement of said plunger element in the plane defined by said electrical circuit portion.

17. The plunger element according to claim 16 wherein said profiled portion is positioned to restrict fore and aft movements of said plunger element with respect to said body.

18. The plunger element according to claim 16 wherein said profiled portion is positioned to restrict side-to-side movements of said plunger element with respect to said body.

19. The plunger element according to claim 16 wherein said body comprises a vertical limiting mechanism for locating said plunger element in said body during assembly of said switch assembly.

20. The switch assembly according to claim 9, wherein said first and second movements are separate stages in a same direction.

21. The switch assembly according to claim 9, wherein said first and second movements are in different directions.

22. A method of assembling an electrical switch assembly, said method comprising:

determining whether said switch assembly provides a single stage operation using a first movement of a pivotally attached actuation button or a dual stage operation using a second movement of said pivotally attached actuation button;

obtaining an elastomeric portion comprising a first active collapsible dome to be collapsed during said first movement and a second passive collapsible dome to be collapsed during said second movement when said switch assembly provides said single stage operation; and assembling said switch assembly by supporting said elastomeric portion on an electrical circuit portion comprising an electrical contact aligned with said first active collapsible dome, and attaching said actuation button to a body of said switch assembly for interacting with a plunger element between said actuation button and said elastomeric portion to operate on said collapsible domes during said first and second movements.

23. The method according to claim 22, wherein said first and second movements are separate stages in a same direction.

24. The method according to claim 22, wherein said first and second movements are in different directions.

* * * * *

UNITED STATES PATENT AND TRADEMARK OFFICE

CERTIFICATE OF CORRECTION

PATENT NO. : 8,138,432 B2
APPLICATION NO. : 12/401230
DATED : March 20, 2012
INVENTOR(S) : Christopher Larsen, Albert Beyginian and Theodor Nuica It is certified that error appears in the above-identified patent and that said Letters Patent is hereby corrected as shown below:

IN THE CLAIMS:

In column 12, line 53 of claim 22, "assembly provides said single stage operation; and" is deleted and replaced with "assembly provides said dual stage operation; and"

Signed and Sealed this
Nineteenth Day of March, 2013

Teresa Stanek Rea
*Acting Director of the United States Patent and Trademark Office*